US006233836B1

(12) United States Patent
Uhlmann et al.

(10) Patent No.: US 6,233,836 B1
(45) Date of Patent: May 22, 2001

(54) DAY AND NIGHT WEAPON SIGHTS

(75) Inventors: Julius H. Uhlmann; John E. Baker, both of Huntsville, AL (US)

(73) Assignee: Highlander Sports, Inc., Huntsville, AL (US)

( * ) Notice: Subject to any disclaimer, the term of this patent is extended or adjusted under 35 U.S.C. 154(b) by 0 days.

(21) Appl. No.: 09/298,170

(22) Filed: Apr. 23, 1999

(51) Int. Cl.[7] ..... F41G 1/32
(52) U.S. Cl. ..... 33/241; 33/261
(58) Field of Search ..... 33/241, 242; 42/103

(56) References Cited

U.S. PATENT DOCUMENTS

| | | | | |
|---|---|---|---|---|
| Re. 35,347 | | 10/1996 | Bindon | 33/241 |
| 3,218,718 | | 11/1965 | Hays | 33/52 |
| 3,500,545 | * | 3/1970 | Chivers | 33/233 |
| 3,641,676 | * | 2/1972 | Knutsen et al. | 33/52 |
| 4,020,203 | | 4/1977 | Thuler | 428/35 |
| 5,070,619 | * | 12/1991 | Santiago | 33/242 |
| 5,101,589 | * | 4/1992 | Duncan | 42/71.02 |
| 5,359,800 | * | 11/1994 | Fisher et al. | 42/103 |
| 5,471,777 | * | 12/1995 | McDonald | 42/103 |
| 5,519,941 | | 5/1996 | Yusko | 33/252 |
| 5,638,604 | * | 6/1997 | Lorocco | 33/241 |
| 5,735,070 | * | 4/1998 | Vasque et al. | 42/1.02 |
| 5,862,618 | * | 1/1999 | Brown | 42/100 |
| 5,878,521 | | 3/1999 | Warnock | 42/103 |
| 5,956,854 | * | 9/1999 | Lorocco | 33/241 |
| 5,992,030 | * | 11/1999 | Mann | 33/243 |
| 6,035,539 | * | 3/2000 | Hollenbach et al. | 33/241 |
| 6,058,615 | * | 5/2000 | Uhlmann et al. | 33/241 |

* cited by examiner

*Primary Examiner*—Michael J. Carone
*Assistant Examiner*—Denise J. Buckley
(74) *Attorney, Agent, or Firm*—Nixon & Vanderhye P.C.

(57) ABSTRACT

Day and night weapon sights have a sight element which includes a rod-shaped light guide, and a self-luminescent capsule integrally co-located within an end of the light guide. Preferably, the light guide is formed of a rod-shaped fluorescently dyed transparent plastics material and the self-luminescent capsule includes a radioactive luminescent source (e.g., tritium).

29 Claims, 3 Drawing Sheets

DAY AND NIGHT WEAPON SIGHTS

FIELD OF THE INVENTION

The present invention relates generally to sighting devices for projectile weapons, such as archery bows and personal firearms. In preferred embodiments, the present invention relates to weapon sights which can be used effectively for both day and night weapon sightings.

BACKGROUND AND SUMMARY OF THE INVENTION

Projectile weapons, especially personal firearms, such as rifles, shotguns and pistols, are typically aimed at targets using some form of sighting device. In this regard, the sighting device is typically fixed to the gun in alignment with the sight line of the gun barrel. In such a manner, the gun's barrel may be brought to bear on a visually acquired target so that a high likelihood exists that the target will be hit when the gun is discharged.

In copending U.S. patent application Ser. No. 09/038,065 filed on Mar. 11, 1998 (the entire content of which is expressly incorporated hereinto by reference), there are disclosed gun sights which include one or more rod-shaped light guides. In preferred embodiments, the gun sights of the copending '065 patent application include one or more light guides that are formed from a suitable optically clear plastics material and dyed or colored with a fluorescent pigment to enhance their visibility. While the gun sights disclosed in the copending '065 patent application are entirely satisfactory for daylight gun sightings, their use at night is limited due to the minimal amount of ambient light that is usually available.

Recently, in copending U.S. patent application Ser. No. 09/287,100 filed on Apr. 7, 1999, the entire content of which is incorporated hereinto by reference, there are disclosed combination day and night weapon sighting devices which necessarily include at least one rod-shaped light guide and a visible self-luminescent capsule closely vertically adjacent thereto. These disclosed day/night sights are suitably employed in daylight and night conditions, but require slightly different "zero" ranges due to the vertical mounting of the day sighting member and the night sighting member. In other words, if the day sighting members are range-zeroed, then the night sighting members deviate from the zero aiming point requiring the marksman to adjust his aim accordingly.

It would therefore be quite desirable if a combination day/night sighting device could be provided which minimizes (if not eliminates entirely) these problems. That is, it would be highly desirable if a combination day/night sight could be employed that does not require different range-zeroed aiming points. It is towards providing such an improved sighting device that the present invention is directed.

Broadly, the present invention is embodied in a combination day and night sight which is comprised of a sight element which includes a rod-shaped light guide, and a self-luminescent capsule integrally co-located within an end of the light guide. Most preferably, the self-luminescent capsule is coaxially embedded in a rear end of the light guide so that an annular region of the light guide surrounds entirely the visible face of the capsule. As such, the light guide may be used for daylight sighting purposes and the self-luminescent capsule may be used for night sighting purposes without substantial (if any) adjustment of their respective "zeroed" aiming points.

Further aspects and advantages of the present invention will become more clear from the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein, FIG. 1 is a rear perspective view of a handgun which is provided with a gun sight in accordance with the present invention;

DETAILED DESCRIPTION OF THE INVENTION

Figure 1:
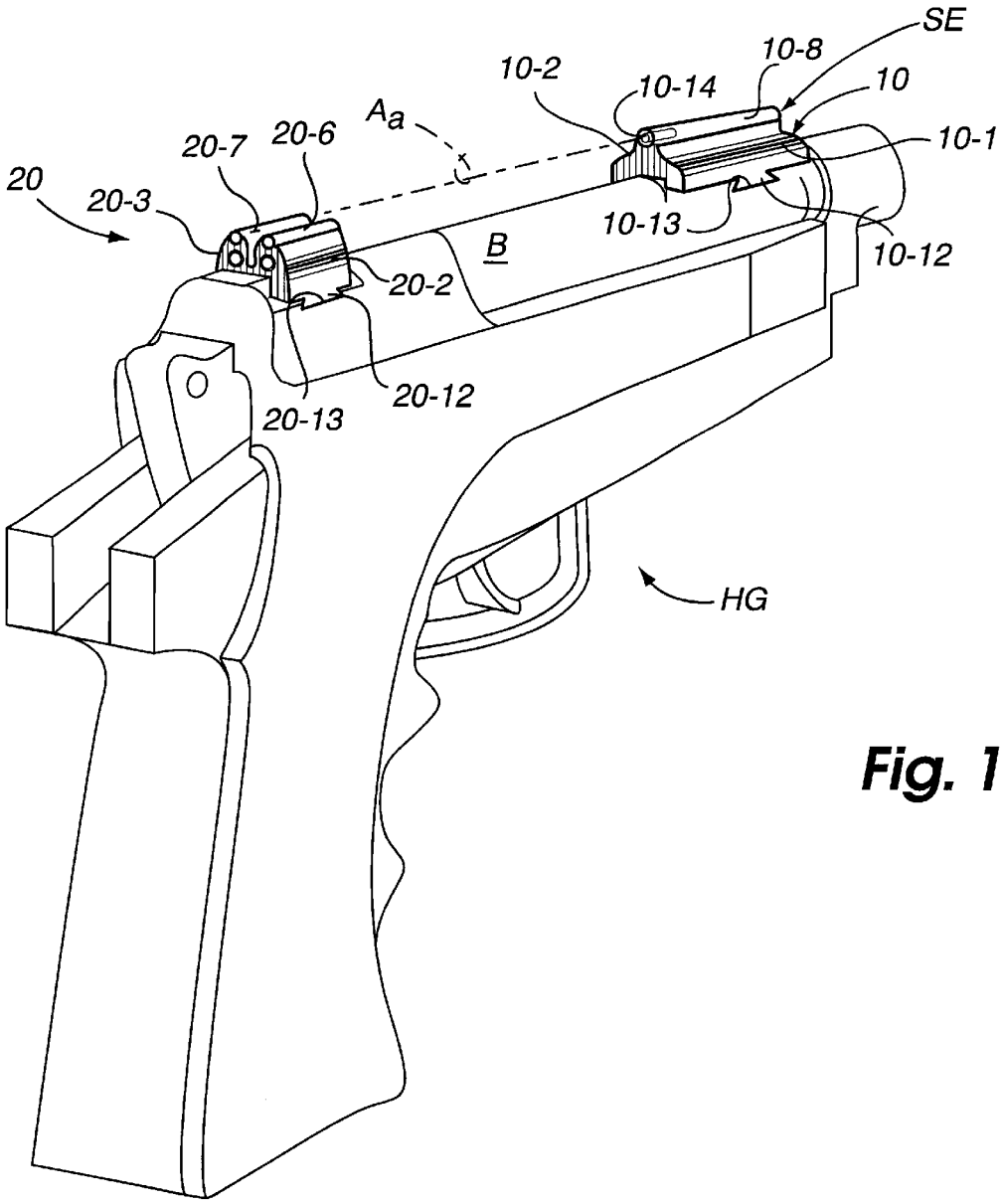

Front and rear gun sights 10, 20, respectively, are shown in accompanying FIG. 1 positioned along the sight line of a typical handgun HG. In this regard, it will be appreciated that, although the sights 10, 20 are depicted in FIG. 1 as being mounted to handgun HG and will be described in greater detail in that exemplary environment of use, the gun sights disclosed hereinafter also find utility when combined with shoulder-mounted firearms (e.g., rifles, shotguns and the like) as well as archery bow weapons.

It will be observed that the front sight 10 is positioned along the barrel B of the handgun HG at its forward end, while the rear gun sight 20 is aligned with the front sight 10 along the barrel B, but positioned at its rearward end thereof. In such a manner, therefore, the user of the handgun HG will be able to bring the barrel B to bear accurately on a visually acquired target by bringing the front and rear sights 10, 20, respectively, into visual alignment with one another and with the intended target. By aiming the handgun HG in this way, the user will have a high probability of striking the target when discharged.

Figure 2:
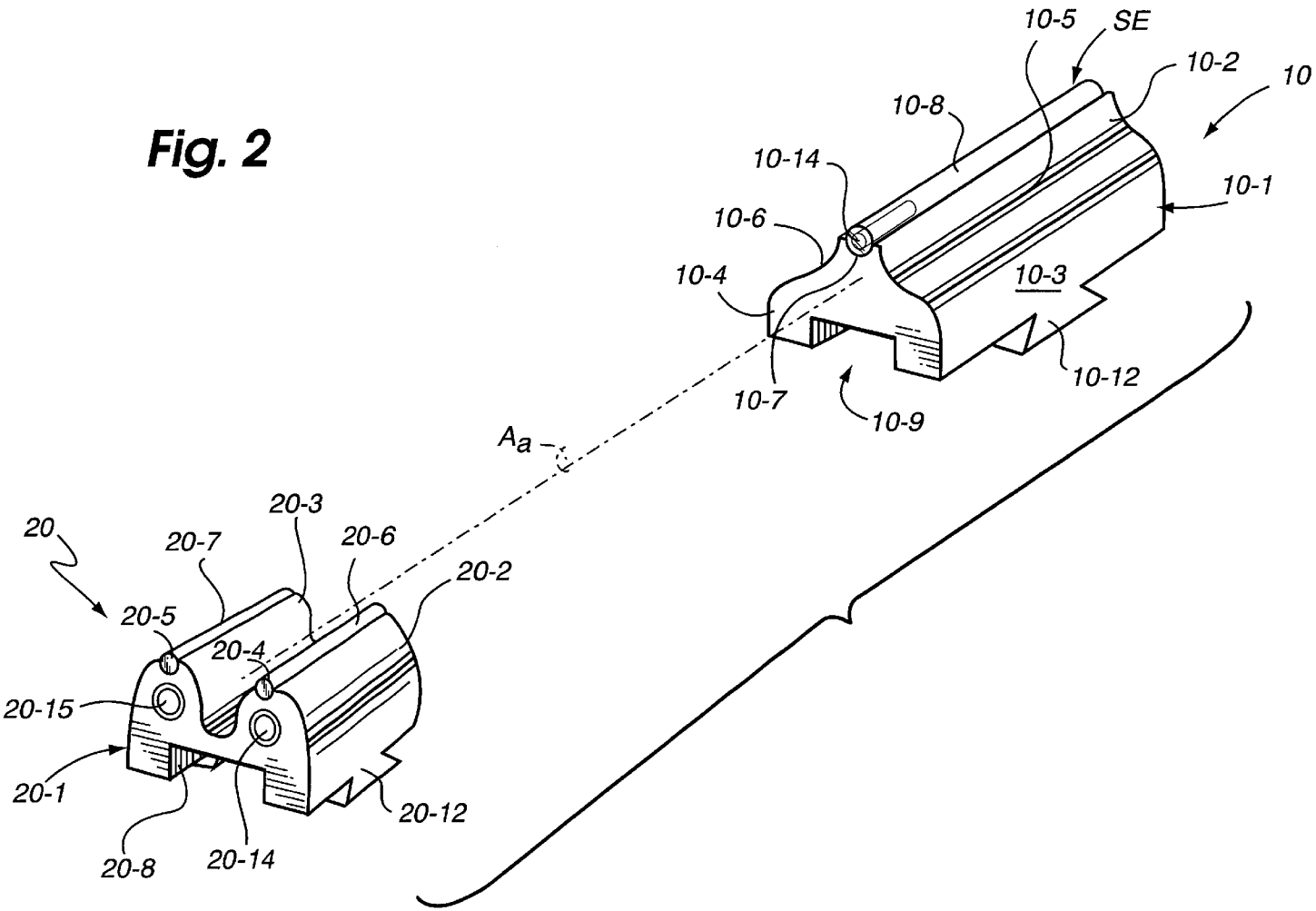
FIG. 2 is an enlarged rear perspective view of the gun sights employed on the handgun depicted in FIG. 1.

The gun sights 10, 20 are shown in greater detail in accompanying FIG. 2. In this regard, it will be observed that the front gun sight includes an axially elongate mounting base member 10-1. The base member 10-1 is provided with an upwardly projecting, central ridge 10-2. The ridge 10-2 is joined to side walls 10-3, 10-4 by opposed, concave transition surfaces 10-5, 10-6, respectively. The ridge 10-2 is itself provided at its apex with an axially extending semi-cylindrical concave surface 10-7 which conforms closely to the circular cross-section of the rod-shaped light guide 10-8 associated with the sighting element SE.

The mounting base 10-1 also defines a lower channel 10-9 extending its entire lengthwise dimension. The channel 10-9 is dimensioned so as to fit onto the barrel B of the handgun HG. The base 10-1 is also provided with a wedge-shaped male member 10-12 which mates with a corresponding configured female guideway 10-13 of the handgun HG so as to positionally fix the mounting base 10-1, and hence the sight 10, thereto.

Importantly, the front sight 10 is also provided with a fixed-position, self-luminescent capsule 10-14 which continuously emits a point or dot of light. Most preferably, the self-luminescent capsule 10-14 is a radioactive luminescent source, such as tritium, as disclosed more fully in U.S. Pat. Nos. 4,020,203; Re. 35,347 and 5,878,521 (the entire content of each being incorporated expressly hereinto by reference). The capsule 10-14 is fixedly embedded within the rearward end of the rod-shaped light guide 10-8 so as to be visible to the marksman when the handgun HG is aimed.

The preferred capsules 10-14 employed in the practice of this invention will advantageously have an outside diameter of between about 0.035 inch to about 0.080 inch. It is especially preferred in this regard that the diameter of the capsules 10-14 be as small as possible, for example, between about 0.035 inch to about 0.050 inch, so as to maximize the annular area of the light guide 10-8 which surrounds the capsule 10-14. In this regard, the capsules will most preferably be in the form of a sealed glass (or other light transparent rigid material) tube having a diameter between about 0.035 inch to about 0.050 inch which contains a radioactive source therein (e.g., such a gaseous tritium luminous source). The sealed glass (or other transparent) tubes forming the capsules 10-14 in such a case will most preferably be coated with an opaque paint or coating material 10-18 (see FIG. 3) so as to enhance and focus the luminescence therefrom. Any suitable paint or coating may be provided for this purpose. In such an arrangement, therefore, the rigid housing typically employed with conventional self-luminescent capsules is not necessarily employed in the practice of this invention. However, in some applications where larger rod-shaped light guides 10-8 are desired (and thereby larger diameter self-luminescent capsules may be employed), then the capsules 10-14 may include the sealed self-luminescent glass tube as described above contained in a rigid housing.

Figure 4:
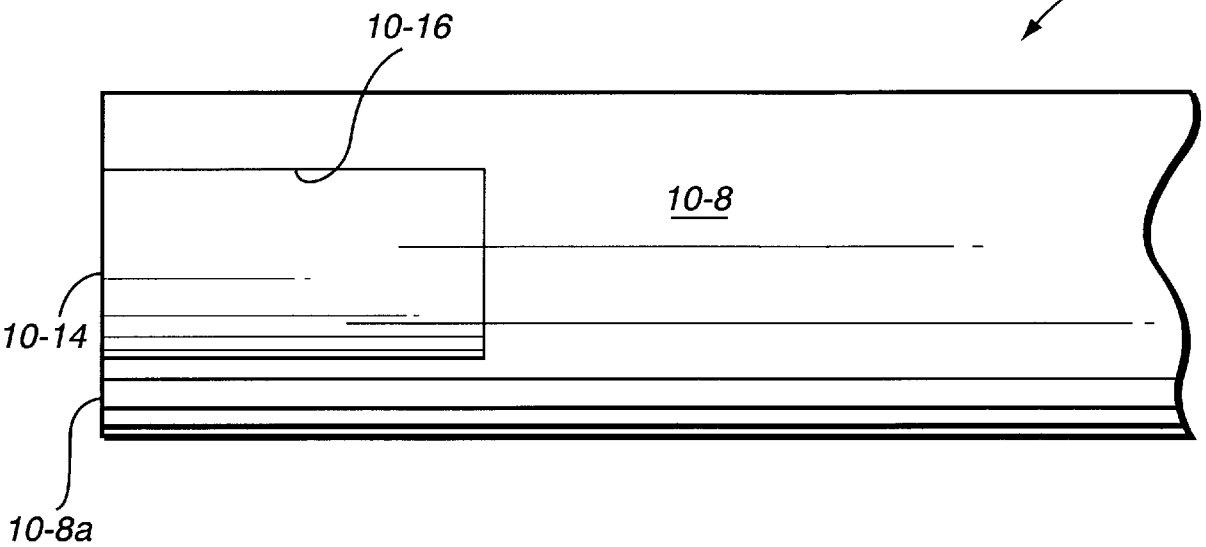
FIG. 4 is a partial right side elevational view of the sighting element depicted in FIG. 3.
Figure 3:
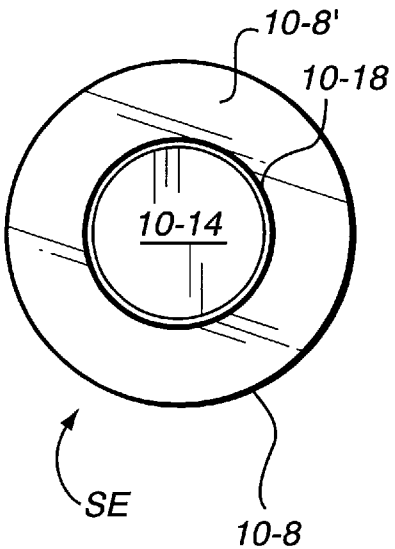
FIG. 3 is an even further enlarged rear elevation view of the preferred sighting element according to this invention.

As can perhaps be seen more clearly in FIGS. 3 and 4, the sighting element SE is comprised of the rod-shaped light guide 10-8 and a generally cylindrical self-luminescent capsule 10-14 co-located therewith. Most preferably, the capsule is coaxially embedded into an open-ended recessed pocket 10-16 formed into the rear end of the light guide 10-8. In such a manner, therefore, an annular region 10-8*a* of the light guide 10-8 at its rear end coaxially surrounds entirely the circular face of the capsule 10-14. Thus, both the light guide 10-8 and the capsule 10-14 of the sighting element SE are capable of being range-zeroed at the same aiming point.

The light guides employed in the gun sights of the present invention are, in and of themselves, highly conventional. In this regard, the light guides are typically formed from a suitable optically clear plastics material such as polystyrene, polyacrylic or polytetrafluoroethylene, and are most preferably dyed or colored with a fluorescent pigment to enhance their visibility. The light guide may optionally be provided with an optically transparent coating thereon of a suitable plastics material and/or may be provided with a scratch-resistant sleeve member. The light guides are rod-shaped elements having lengths between about 0.50 to about 1.5 inches and a diameter between about 0.055 to about 0.250 inch and more preferably between about 0.075 to about 0.125 inch. In particularly preferred embodiments, the light guides for the front and rear sights 10, 20, respectively, will be between about 0.60 and about 1.40 inch in length (±0.015 inch) and will have diameters ranging between about 0.090 to about 0.118 inch (±0.004 inch).

The rear sight 20 may be of the type disclosed in co-pending U.S. patent application Ser. No. 09/287,100 filed on Apr. 7, 1999. In this regard, like the front sight 10, the rear sight 20 includes a mounting base 20-1 provided with a laterally separated (relative to the aiming axis $A_a$) parallel apical protrusions 20-2, 20-3. Each protrusion includes a semi-cylindrical concave surface 20-4, 20-5 which receive therein a respective one of the rod-shaped light guides 20-6, 20-7. A generally rectangular lower channel 20-8, and male and female mounting structures 20-12, 20-13, respectively, are provided for the same purposes as their corresponding structure 10-12, 10-13 in front sight 10—that is, to positionally fix the sight 20 to the barrel B of the handgun HG.

The rearward vertical surface of each of the apical protrusions 20-2, 20-3 is provided with self-luminescent capsules 20-14, 20-15, respectively. Each of the self-luminescent capsules is inserted into the rear surface of the apical protrusions 20-2, 20-3 so as to be fixedly positioned immediately vertically adjacent the rearward end of the light guides 20-6, 20-7, respectively. That is, a vertical bisecting plane parallel to the aiming axis $A_a$ bisects both the capsules 20-14, 20-15 and their respective the light guides 20-6 and 20-7.

The apical protrusions 20-2 and 20-3 are separated by a semi-cylindrical valley 20-16 which extends longitudinally in alignment with the aiming axis $A_a$. Most preferably, the radius of the semi-cylindrical surface is in close conformance to the radius of the capsule 10-14 of the front sight 10. In addition, as is evident from FIG. 3, the generatrices of the semi-cylindrical valley 20-16 are aligned with a horizontal plane which bisects both the capsules 20-14 and 20-15 as well as the capsule 10-14 when the front and rear sights 10, 20, respectively, are aligned along the aiming axis $A_a$. When aligned in such a manner as depicted in FIG. 3, the user of the handgun HG will be visually confident that the handgun HG is aimed properly.

It will be noted that the relative diameter of the light guide 10-8 is different as compared to the diameters of each of the light guides 20-6, 20-7. More specifically, the diameter of the front light guide 10-8 is approximately at least about 25% larger than the diameters of the rear light guides 20-6, 20-7. Thus, when the front and rear sights 10 and 20, respectively, are longitudinally separated along the barrel B of the handgun HG as shown in FIG. 1, the perceived diameter of the front light guide 10-8 will decrease so that it visually appears to be substantially the same diameter as the pair of rear light guides 20-6, 20-7. In other words, FIG. 3 shows the literal non-perspective dimensional relationship between the light guides 10-8 on the one hand, and the light guides 20-6, 20-7 on the other hand. In use, the sight picture will be such that the front light guide 10-8 will appear to have substantially the same diameter as the light guides 20-6, 20-7 since the front and rear sights 10, 20 will be viewed in a background/foreground perspective. The relative diameters of the front and rear light guides 10-6 and 20-6, 20-7 can therefore be selected in dependence upon their relative separation distance when positioned on a weapon so that the relative diameters of the front and rear light guides 10-6 and 20-6, 20-7 will visually appear to be substantially the same when a user aims the weapon.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sighting element comprised of:

(i) a rod-shaped light guide formed from a transparent plastics material and having a proximal end exposed to a user when aiming, and (ii) a self-luminescent capsule having a generally circular face exposed to the user when aiming and containing a radioactive luminescent source of light which is visible through said face, said capsule being coaxially embedded in said proximal end of the light guide so that the visible face of said capsule is coplanar with and surrounded entirely by an annular region of the light guide at said proximal end thereof.

2. The sighting element of claim 1, wherein said radioactive luminescent source is tritium.

3. The sighting element of claim 1, wherein said self-luminescent capsule is coated with an opaque coating material.

4. The sighting element of claim 1, wherein said end of the light guide defines a coaxial open ended recess, and wherein said capsule is received within said recess.

5. The sighting element of claim 4, wherein said recess and said capsule are coaxially positioned relative to said light guide such that an annular region of said light guide at said end thereof surrounds a visible face of said capsule.

6. The sighting element of claim 1, wherein said light guide is formed of a rod-shaped fluorescently dyed transparent plastics material.

7. The sighting element of claim 1, wherein said self-luminescent capsule has a diameter of between about 0.035 to about 0.080 inch.

8. The sighting element of claim 1, wherein said self-luminescent capsule includes a sealed glass tube, gaseous tritium contained within said tube, and an opaque coating on an exterior surface of said tube.

9. A day and night weapon sight comprising:

a base for mounting to a weapon, and a sight element supported by said base, wherein said sight element includes:

(i) a rod-shaped light guide formed from a transparent plastics material and having a proximal end exposed to a user when aiming, and (ii) a self-luminescent capsule having a generally circular face exposed to the user when aiming and containing a radioactive luminescent source of light which is visible through said face, said capsule being coaxially embedded in said proximal end of the light guide so that the visible face of said capsule is coplanar with and surrounded entirely by an annular region of the light guide at said proximal end thereof.

10. The sight of claim 9, wherein said light guide is formed of a rod-shaped fluorescently dyed transparent plastics material.

11. The sight of claim 9 or 10, wherein said radioactive luminescent source is tritium.

12. The sight of claim 9 or 10, wherein said self-luminescent capsule is coated with an opaque coating material.

13. The sight of claim 9, wherein said end of the light guide defines a coaxial an open-ended recess, and wherein said capsule is received within said recess.

14. The sight of claim 9, wherein said mounting base has at least one axially elongate, apical protrusion, and wherein said light guide is fixed to an upper region of said apical protrusion.

15. The sight of claim 14, wherein said apical protrusion includes an axially extending semi-cylindrical surface which receives said light guide therein.

16. The sight of claim 9, wherein said self-luminescent capsule has a diameter of between about 0.035 to about 0.080 inch.

17. The sight of claim 9 or 16, wherein said self-luminescent capsule includes a sealed glass tube, gaseous tritium contained within said tube, and an opaque coating on an exterior surface of said tube.

18. The combination comprising a projectile weapon and a sight of claim 1 or 9.

19. The combination of claim 18, wherein the projectile weapon is a personal firearm.

20. A weapon sighting system for day and night weapon sighting comprising:

a front sight and a rear sight mountable to a weapon so as to be aligned with one another along an aiming axis thereof, wherein said front sight includes;

a front mounting body having a central ridge extending longitudinally relative to the aiming axis; and a front sight element fixed to said central ridge, wherein said front sight element includes (i) a rod-shaped light guide formed from a transparent plastics material and having a proximal end exposed to a user when aiming, and (ii) a self-luminescent capsule having a generally circular face exposed to the user when aiming and containing a radioactive luminescent source of light which is visible through said face, said capsule being coaxially embedded in said proximal end of the light guide so that the visible face of said capsule is coplanar with and surrounded entirely by an annular region of the light guide at said proximal end thereof.

21. The sighting system of claim 20, wherein said light guide is formed of a rod-shaped fluorescently dyed transparent plastics material.

22. The sighting system of claim 20 or 21, wherein said radioactive luminescent source is tritium.

23. The sighting system of claim 22, wherein said self-luminescent capsule is coated with an opaque coating material.

24. The sighting system of claim 20, wherein said end of the light guide defines a coaxial open-ended recess, and wherein said capsule is received within said recess.

25. The sighting system of claim 20, further comprising a mounting base, wherein said sighting element is supported by said mounting base.

26. The sighting system of claim 25, wherein said mounting base has at least one axially elongate, apical protrusion, and wherein said light guide is fixed to an upper region of said apical protrusion.

27. The sighting system of claim 26, wherein said apical protrusion includes an axially extending semi-cylindrical surface which receives said light guide therein.

28. The combination comprising a projectile weapon and a sighting system of claim 20.

29. The combination of claim 28, wherein the projectile weapon is a personal firearm.

* * * * *